United States Patent [19]

Chattin

[11] Patent Number: 4,993,399

[45] Date of Patent: Feb. 19, 1991

[54] BOWSTRING APPARATUS

[76] Inventor: Jesse Chattin, 3409 - 22nd St. Causeway, Tampa, Fla. 33619

[21] Appl. No.: 363,343

[22] Filed: Jun. 6, 1989

Related U.S. Application Data

[63] Continuation of Ser. No. 132,958, Dec. 15, 1987, abandoned, which is a continuation-in-part of Ser. No. 827,642, Feb. 10, 1986, Pat. No. 4,724,820.

[51] Int. Cl.[5] ..... F41B 5/00

[52] U.S. Cl. ..... 124/25.6; 124/90; 124/900

[58] Field of Search ..... 124/23 R, 24 R, 86, 124/90, DIG. 1

[56] References Cited

U.S. PATENT DOCUMENTS

| | | | |
|---|---|---|---|
| 3,987,777 | 10/1986 | Darlington | 124/23 R |
| 3,990,425 | 11/1976 | Ketchum | 124/23 R |
| 4,103,667 | 8/1978 | Shepley | 124/24 R |
| 4,365,611 | 12/1982 | Nishioka | 124/24 R |
| 4,368,718 | 1/1983 | Simonds et al. | 124/23 R |
| 4,370,972 | 2/1983 | Stewart et al. | 124/23 R |
| 4,401,097 | 8/1983 | Simonds et al. | 124/23 R |
| 4,440,143 | 4/1984 | Nishioka | 124/24 R |
| 4,512,326 | 4/1985 | Jarrett | 124/23 R |
| 4,561,413 | 12/1985 | Jennings | 124/23 R |
| 4,646,708 | 3/1987 | Imes | 124/24 R |
| 4,672,943 | 6/1987 | Bozek | 124/23 R |
| 4,724,820 | 2/1988 | Chattin | 124/23 R |

*Primary Examiner*—Randolph A. Reese
*Assistant Examiner*—John A. Ricci

[57] ABSTRACT

A bowstring apparatus for use with an archer's bow comprising a pair of ring members each rotatably mounted on an axle pin with a tip interconnector attachably securing each limb tip to each axle pin and further interconnecting each axle pin to each other to enable each ring member to rotate about a parallel axle pin axis relative each other and with an arc member axially spaced on the axle pin and securely attached to the ring member so as to permit simultaneous rotation about the axle pin when the ring member rotates. A flexible cord member secures together each distal end of the arc member to enable simultaneous tensioning when the ring members are tensioned. A bowstring is secured to each rotatably mounted ring member and extends between each rotatably mounted ring member whereby tensioning the bowstring tensions and flexes the upper and lower limbs of the bow and enables the ring members to rotate thereby permitting the bowstring to be rotatably released from the rotatably mounted rings and further enables the flexible cord member to be guidably and rotatably received on the arc members thereby mechanically storing the force to tension the bowstring and enabling the bowstring to be held in a firing position.

44 Claims, 6 Drawing Sheets

BOWSTRING APPARATUS

RELATED APPLICATION

This application is a continuation; of application Ser. No. 132,958, filed Dec. 15, 1987, now abandoned, which is a continuation-in-part of Ser. No. 827,642, filed Feb. 10, 1986, now Pat. No. 4,724,820, the disclosure of which is incorporated by reference as if fully set forth herein.

BACKGROUND OF THE INVENTION

1. Field of the Invention

This invention relates to a bowstring apparatus which permits the modification of a conventional archer's longbow, including a recurve bow, to provide for a mechanical advantage resulting in less force to draw the bow to a loaded position and to hold the drawn bow in a loaded position.

2. Description of the Prior Art

Presently the crossbow, longbow and compound bow are used in archery. The crossbow is heavy, cumbersome and awkward to load. However, once loaded an archer can take steady aim and fire the bow by a trigger means making it a relatively accurate bow.

The longbow which is lighter and easier to load than the crossbow, propels an arrow a greater distance than the crossbow. The longbow can also be fired with a faster rapidity than the crossbow. The longbow, however, requires a lot of force to draw and to hold in a drawn or loaded position, therefore accuracy falls off the longer the drawn position is held.

The compound bow utilizes the advantage of the cross bow by permitting a drawn position to be held without the force necessary to draw the bowstring into a loaded position while being lighter and less cumbersome than a crossbow. However, the compound bow is relatively heavy, awkward and noisy to use compared to the longbow. Its present popularity is based upon its ability to be more accurate than the longbow since it requires less force to maintain in the drawn position and therefore is easier to aim. This advantage is most notable where the archer maintains a drawn position waiting for his quarry to come into range.

The prior art uses a combination of electrically mounted pulleys, eccentric wheel assemblies and rotating lever assemblies mounted on the bow limbs to obtain a mechanical advantage permitting the use of less force to drawn and to hold the bow in a loaded or drawn position than would be required without the above apparatus.

One prior art patent teaches a compound bow apparatus which utilizes cam members eccentrically mounted on the bow limb tips. The cam comprises a planar member which includes a main body section which has an outwardly extending and curved lever or hook section which projects forwardly of the plane of the main body. The bowstring is securably attached to each distal end portion of the hook section. Tension cables are securably attached to the main body section and extend to the opposite cam pivot shaft where they are anchored. Upon tensioning the bowstring, the bowstring is released from each hook section with contemporaneous rotational tension upon the tension cables.

Another patent teaches a compound bow which utilizes a pair of levers rigidly affixed with a pulley whereby tensioning the bowstring causes the synchronizing cable to synchronize the position of each of the levers which also are connected to the bowstring.

Another patent teaches a compound bow with eccentric wheel assemblies. The wheel assemblies include a bowstring wheel, a first take up wheel and a second take up wheel. The second take up wheel is secured to the bowstring wheel and includes a peripheral groove which is aligned with the groove of the first take up wheel. When the bow is drawn the bowstring is received in a groove of the second take up wheel. The characteristics of the bow are changeable by substituting various shapes of the second take up wheel.

Another patent disclosure teaches limb mounted eccentric pulleys in a compound bow where the drawstring wraps around the primary pulleys and tension cables wrap around secondary pulleys. When the bowstring is tensioned, the bowstring unwraps from the primary pulleys causing the pulley assemblies to rotate. Simultaneously tension cables wrap around the secondary pulley causing the limbs to flex. This combination is said to result in a greater amount of stored energy in the bow when drawn.

Another prior art disclosure teaches an archer's bow with rotatable rocker arm members attached to the limbs of the bow. The rocker arm members further comprise a pulley integrally attached to the rocker arms. The pulleys insure simultaneous rotation of the rocker arms when the bowstring is drawn. A bowstring connects the rocker arms and an elastic device also connected to the rocker arm resists rotation of the rocker arms. The pulleys insure substantially equal but opposite angular displacement of the rocker arms.

Another prior art disclosure teaches a device for retaining a compound bow in a partially drawn position. The object of the invention is obtained by using a ratchet means which holds a compound bow in a partially drawn position and releases its hold as the bow reaches a fully drawn condition of the bow.

It is a primary objective of this invention to provide an apparatus which overcomes the aforementioned difficulties of the prior art devices and provides an improvement which is a substantial contribution to the advancement over the archer's bow art.

It is an object of this invention to provide a bowstring apparatus which is readily attachable to a conventional longbow including a recurve bow.

It is a further object of this invention to provide a bowstring apparatus that greatly increases the accuracy and greatly reduces fatigue in operation of the longbow or recurve bow.

It is a further object of this invention to provide a bowstring apparatus which does not appreciably twist the bow limp tips and can be strung on a conventional longbow or recurve bow.

It is a further object of this invention to provide a bowstring apparatus which may be readily strung on a conventional bow to enable the bow to be held in a loaded position yet does not require that the apparatus be mounted on split limb tips as required with conventional compound bow apparatus.

It is a further object of this invention to provide a bowstring apparatus which allows for the modification of a longbow or recurve bow to permit the storage of energy in the bow structure thereby limiting the amount of force the archer is required to hold the bow in a drawn position.

It is a further object of this invention to provide a bowstring apparatus which does not require specially designed limb tips to attach the bowstring apparatus to the bow.

It is a further object of this invention to provide a bowstring apparatus which enables a conventional longbow or recurve bow to be held in a full drawn position with less force than the draw weight of the bow.

It is a further object of this invention to provide a bowstring apparatus where the draw force diminishes beyond a certain drawn point to ease the tension on the archer's drawn arm to hold in a loaded position.

It is a further object of this invention to provide a bowstring apparatus which allows for changes in the draw weight of the conventional longbow or recurve bow.

It is a further object of this invention to provide a bowstring apparatus which is easily attachable to a conventional longbow or recurve bow by "stringing" the bowstring apparatus between the upper and lower bow limb tips.

It is a further object of the bowstring apparatus to provide for changes in the draw length of the conventional longbow or recurve bow.

The foregoing has outlined rather broadly the more pertinent and important features of the present invention in order that the detailed description that follows may be better understood so that the present contribution to the art can be more fully appreciated. Additional features of the invention will be described hereinafter which forms the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

SUMMARY OF THE INVENTION

The bowstring apparatus of the present invention is defined by the appended claims with specific embodiments shown in the attached drawings. Of the purpose of summarizing the invention, the invention relates to a bowstring apparatus for use with a conventional archer's bow including a handle, upper and lower flexible limbs extending from the handle and each limb terminating in an upper and lower tip. The bowstring apparatus of the invention replaces the bowstring of a conventional bow. "Conventional bow" as used herein embraces any bow the apparatus can be readily attached to such as the longbow and the recurve bow.

The bowstring apparatus of the invention is best described as a pair first and second ring members each rotatably mounted on an axle pin to enable rotation about the axle pin and with a tip interconnector means attachably securing and interconnecting each limb tip to each axle pin and further interconnecting each axle pin to each other thereby enabling each ring member to rotate about a parallel axle pin axis relative to each other. An arc member is axially spaced on each axle pin and securably attached to each ring member, and extends outwardly and in a plane parallel the ring member so as to permit simultaneous rotation about the axle pin when the ring member rotates. A flexible cord member extends between and secures together the distal ends of each arc member to enable simultaneous tensioning when each ring member is tensioned. A bowstring is secured to each rotatably mounted ring member and extends between each rotatably mounted ring member whereby tensioning the bowstring tensions and flexes the upper and lower limbs of the bow and enables the first and second ring members to rotate thereby permitting the bowstring to be rotatably released from the rotatably mounted rings and further enables the flexible cord member to be guidably and rotatably received on the arc members thereby mechanically storing the force to tension the bowstring and enabling the bowstring to be held in a firing position. Upon release of the bowstring the flexible cord member is guidably and rotatably received on the arc members and the rotatably mounted rings cooperate to apply the stored force required to tension and flex the upper and lower limbs to the bowstring and ultimately to propel the arrow positioned on the bowstring.

In another embodiment of the invention, the bowstring apparatus of the invention is best described as a first and second ring member each rotatably mounted on an axle pin to enable rotation about the axle pin and with a tip interconnector means attachably securing and interconnecting each limb tip to each axle pin and further interconnecting each axle pin to each other thereby enabling each ring member to rotate about a parallel axle pin axis relative to each other. An arc member is axially spaced on each axle pin and securably attached to each ring member extends outwardly away from each ring member so as to permit simultaneous rotation about the axle pin when the ring member rotates. A flexible cord member extends between and secures together the distal end of each arc member to enable simultaneous tensioning when each ring member is tensioned. A bowstring is secured to each first and second rotatably mounted ring members and extends between each first and second rotatably mounted ring members whereby tensioning the bowstring tensions and flexes the upper and lower limbs of the bow and enables the first and second ring members to rotate thereby permitting the bowstring to tension each distal end of the first and second arc members and enabling each first and second ring member to guidably and rotatably release the bowstring thereby mechanically storing the force to tension the bowstring and enabling the bowstring to be held in a firing position. Upon release of the bowstring, the flexible cord member guidably tensioned by the distal end of each the first and second arc member cooperate to apply substantially all of the stored force to the bowstring and ultimately to propel the arrow positioned on the bowstring.

In a further embodiment of the invention, the bowstring apparatus further includes a tip interconnecting means which is removably connected to each upper and lower limb tip to enable detachment or destringing of the bowstring apparatus from the bow. This can be accomplished by providing removable loop anchors proximate each limb tip, for example.

The invention also includes an arc member having a groove about its periphery to provide a track or guiding channel for the flexible cord member thereby allowing the flexible cord member to be guidably received by the arc member when the bowstring is tensioned. Furthermore, the first and second ring members may also include a groove about their periphery to provide a tract or guiding channel for the bowstring thereby allowing the bowstring to be guidably released by the ring member when the bowstring is tensioned.

The first and second rotatably mounted ring members are either concentric or eccentric. Generally, the individual ring member is attached to the individual arc member in order to assure simultaneous rotation about the axle pin. Preferably, the individual ring member and individual arc member are integrally formed thereby insuring simultaneous rotation about the axle pin. The individual ring member and arc member further include an axle bore to slidably receive the axle pin thereby enabling rotation about or relative the axle pin. However, it is conceivable that the axle pin could be welded or otherwise affixed to the ring member and arc member and securing the first and second end of the axle pin into a sleeve or pillow block to enable simultaneous rotation of the ring member and arc member. The preferred method utilizes an axle bore in both the ring member and arc member to enable rotation of the ring member and arc member about the axle pin. In the most preferred embodiment of the invention, the ring member and arc member are integrally formed with an axle bore therein to slidably receive the axle pin thereby enabling rotation about the axle pin.

In a further embodiment of the invention the tip interconnector means comprises a first flexible cord connector having a first and second end with the first end of the first flexible cord connector comprising a plurality of cords which terminate in an attachment means for securably connecting the first flexible cord connector to the proximal and distal end of the first axle pin. The second end of the first flexible cord connector comprises a loop for securably connecting the first flexible cord to the upper limb tip.

A second flexible cord connector having a first and second end with the first end comprising a plurality of cords which terminate in an attachment means for securably connecting the second flexible cord connector to the proximal and distal end of the second axle pin. The second end of the second flexible cord connector comprises a loop for securably connecting the second flexible cord to the lower limb tip.

A third flexible connector having a first and second end where the first end of the connector comprises a plurality of cords which terminate in an attachment means for securably connecting the first end of the third flexible cord connector to the proximal and distal end of the first axle pin. The second end of the third flexible cord connector comprises a loop.

A fourth flexible cord connector having a first and second end with the first end of the fourth flexible cord connector comprising a plurality of cords which terminate in an attachment means for securably connecting the first end of the fourth flexible cord connector to the proximal and distal end of the second axle pin. The second end of the fourth flexible cord connector comprises a loop.

An interlinking flexible cord connector having a first and second end where the first and second end include a first and second attachment means for securably attaching the loop of the third flexible cord connector to the first attachment means of the interlinking flexible cord and for securably attaching the loop of the fourth flexible cord connector to the second attachment means of the interlinking flexible cord thereby securably interconnecting the upper limb tip and the lower limb tip with the bowstring apparatus disposed therebetween. The bowstring apparatus is disposed or "hangs" between the limb tips of a conventional bow or recurve bow with the first and second ring members in alignment and with the first and second arc members in alignment to prevent mistracking of their particular cords. Alignment is especially important where grooves are provided in the ring member and/or arc member. This insures ease in take up by the arc member and ease of release by the ring member of the flexible cord and bowstring respectively. The term "cord" as used in the specification and claims describes any string, cable, metal cable, wire, flexible fiber cord, rope, twine, or any other similar materials which may be used for a bow.

Preferably the number of the plurality of cords which terminate in an attachment means to securably attach the proximal and distal ends of the first and second side of the axle pin is two (2). This enables the first and second ring members and the first and second arc members rotatably-mounted on the respective first and second axle pins to be disposed between and rotate within an area defined by the first end of the first flexible connector cord and the first end of the third flexible connector cord and the area defined by the first end of the second flexible connector cord and the first end of the fourth flexible connector cord respectively. This area is referred to as the cord window.

The first and second attachment means of the interlinking flexible cord connector further include a hook for attaching the interlinking flexible cord connector to each loop of the third and fourth flexible cord connector. Furthermore, the first and second attachment means include a flexible cord guide for guiding the flexible cord which is attached to each respective arc member during the tensioning of the bowstring which causes the arc members to rotatably receive the flexible cord. In the preferred embodiment, the flexible cord guide and the hook of the first and second attachment means of the interlinking cord are integrally formed.

In a further embodiment of the invention, the interlinking flexible cord further includes an adjustment means to permit tension adjustment of the tip interconnecting means. That is, the adjustment means allows for the lengthening or shortening of the tip interconnecting means thereby altering the tension. The most preferred adjustment means of the interlinking flexible cord is a turnbuckle.

The first and second flexible cord connectors include a loop anchor to fixedly position the loop between the first and second ends of each of the first and second flexible cord connectors respectively. This will ensure a more secure attachment of the first and second flexible cords to the upper and lower limb tips. Also the third and fourth flexible cord connectors include a loop anchor to fixedly position the loop to the first and second attachment means of the first and second interlinking cord connector, respectively, to ensure a more secure attachment of the third and fourth flexible cord to the interlinking flexible cord connector. In a recurve bow a string raiser is used in place of the loop anchors located proximate the upper and lower limb tips.

In another embodiment of the invention a bowstring secured to the first and second rotatably mounted ring members and extending between each first and second rotatably mounted ring members whereby tensioning the bowstring tensions and flexes the upper and lower limbs of the bow and enables the first and second ring members to rotate thereby permitting the bowstring to be rotatably released from the first and second rotatably mounted ring members and enabling each first and second arc member to guidably and rotatably receive the flexible cord member thereby mechanically storing the force to tension the bowstring and enabling the bowstring to be held in a firing position. Upon release of the bowstring, the flexible cord member guidably and rotatably received by the arc members and each rotatably mounted ring members cooperate to apply substantially all of the force required to tension and flex the upper and lower limbs to the bowstring.

The proximal end of the first and second arc members further include a guiding channel for the flexible cord member to enable the flexible cord to be guidably received by the arc member when the bowstring is tensioned. Furthermore, this embodiment of the invention includes a flexible cord having a first and second end. Each distal end of each arc member further includes a rigid bridge member attachably securing each distal end of each arc member to each first and second end of the flexible cord. The teachings set forth in the first disclosed invention also apply to this embodiment. That is, the axle pins, the ring members, the tip interconnector means, the flexible cord member, and bowstring elements are the same.

To utilize the bowstring apparatus on a recurve bow, a string raiser is positioned by the upper and lower bow limp tip and held in place by flexible cord connector. The string raiser allows the bowstring apparatus of the invention, and particularly the rotating arc member, to rotatably clear the recurve bow limb structure.

The foregoing has outlined rather broadly the more pertinent and important features of the present invention in order that the detailed description that follows may be better understood so that the present contribution of the art can be fully appreciated. Additionally, features of the invention will be described hereinafter which form the subject of the invention. It should be appreciated by those skilled in the art that the conception and the specific embodiment disclosed may be readily utilized as basis for modifying or designing other devices for carrying out the same purposes of the present invention. It should also be realized by those skilled in the art that such equivalent constructions do not depart from the spirit and scope of the invention as set forth in the independent claims.

BRIEF DESCRIPTION OF THE DRAWINGS

For a fuller understanding of the nature and objects of the invention, reference should be had to the following detailed description taken in connection with the accompanying drawings in which:

Similar reference character refer to similar parts throughout the several views of the drawings. Where only one view is illustrated, as in FIGS. 4–19, with various components of the bowstring apparatus, the corresponding view of the apparatus at the opposite limb would be essentially identical and is not illustrated. FIGS. 9–13 illustrate other arc member designs and points of attachments of the flexible cord member to the distal end of the arc member.

DETAILED DISCUSSION

Figure 1:
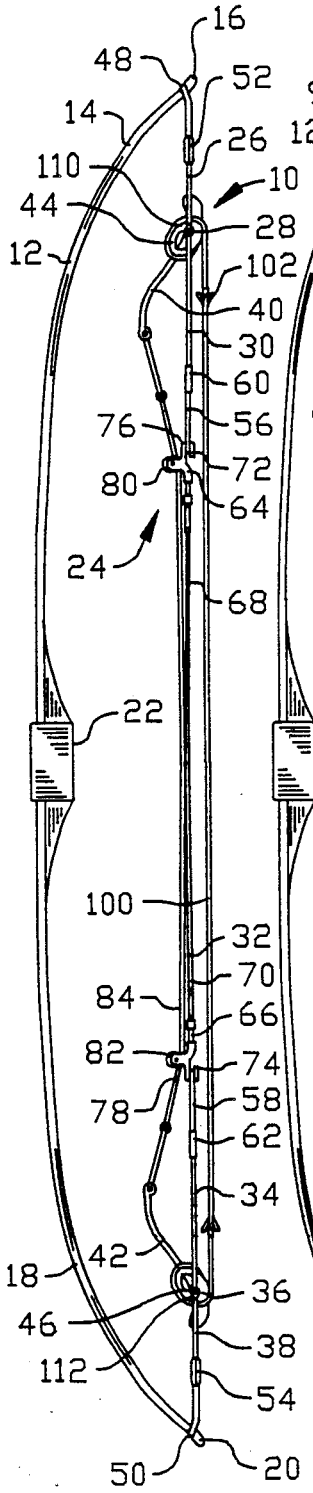
FIG. 1 is a side elevation of the bowstring apparatus of the invention on a bow in a relaxed position.

FIG. 1 is an elevational view of the bowstring device generally designated 10 attached to a conventional bow 12 which includes an upper bow limb 14 terminating in an upper bow limb tip 16 and a lower bow limb 18 terminating in a lower bow limb tip 20 with a handle 22 disposed therebetween. The apparatus of the invention enables a conventional bow or recurve bow to be held in a fully loaded or drawn position with less force than required to draw the bow into a loaded position. The bowstring apparatus 10 includes a tip interconnecting means 24 which attaches the apparatus 10 to upper bow limb tip 16 and to lower bow limb tip 20. The tip interconnecting means 24 includes a first flexible cord connector 26 to securely attach upper bow limb tip 16 to first axle pin 28; and a third flexible cord connector 30 to securely attach first axle pin 28 to an interlinking first connector cord 32; a fourth flexible cord connector 34 to securely attach the interlinking flexible cord connector 32 to second axle pin 36; and a second flexible cord connector 38 to securely attach the second axle pin 36 to lower bow limb tip 20. The first 28 and second 36 axle pin each have an arc member 40,42 and ring member 44,46 respectively, rotatably mounted thereon to enable rotation relative their respective axle pin 28,36. Arc members 40, 42 further include a rigid bridge member best illustrated at FIGS. 9 and 13–16. The tip interconnector means 24 positions the bowstring apparatus 10 in a common plane relative the bow and bowstring of the conventional bow. The preferred method of securably attaching bowstring apparatus 10 to upper 16 and lower 20 bow limb tips is by a loop 48,50 respectively. A loop anchor 52,54 holds each loop 48,50 in position on the fist 26 and second 38 flexible cord connectors. The third 30 and fourth 34 flexible cord connectors also provide a loop 56,58 respectively for the first 64 and second 66 attachment means at first 68 and second 70 ends of interlinking flexible cord connector 32 to securely attach first 68 and second 70 ends of interlinking flexible cord connector 32, respectively. A loop anchor 60,62 holds each loop 56,58 in position on the third 30 and fourth 34 flexible cord connectors, respectively. The most preferred attachment means at first 68 and second 70 ends of interlinking flexible cord connector is an integrally formed hook 72, 74 and flexible cord guide 76,78, respectively. The flexible cord guide 76,78 preferably comprises a wheel 80,82 to guide flexible cord member 84.

The first 28 and second 36 axle pins are securably attached to tip interconnecting means 24 in a manner to enable rotation of ring 44,46 and arc member 40,42 relative the respective axle pin 28,36. The most preferred manner of securably attaching tip interconnecting means 24 to axle pins 28,36 is to securably attach an eyelet 86 (FIG. 4) which has a diameter slightly larger than the diameter of axle pin 28,36 to the second ends of each respective flexible cord connector 26, 30, 34 and 38.

The proximal end of each arc member 88,90 is securably attached to each ring member 44,46 to enable simultaneous rotation about each axle pin 28,36. The distal end of each arc member 92,94 is securably interconnected to a flexible cord member 84 having a first 96 and second 98 end, respectively, as best illustrated at FIG. 2.

A bowstring 100 interconnects and is securely attached to each ring member 44,46. The bowstring may be one piece thereby enabling it to attach to and run along the periphery 110,112 of each ring member 44,46. The term "bowstring" includes a first 106 and second 108 bowstring cable for attaching the bowstring 100 by way of an anchor harness 102,104 to the first 44 and second 46 ring member, respectively as illustrated at FIG. 2. The first 106 and second 108 bowstring cable enable bowstring 100 to be easily and readily replaced.

Figure 2:
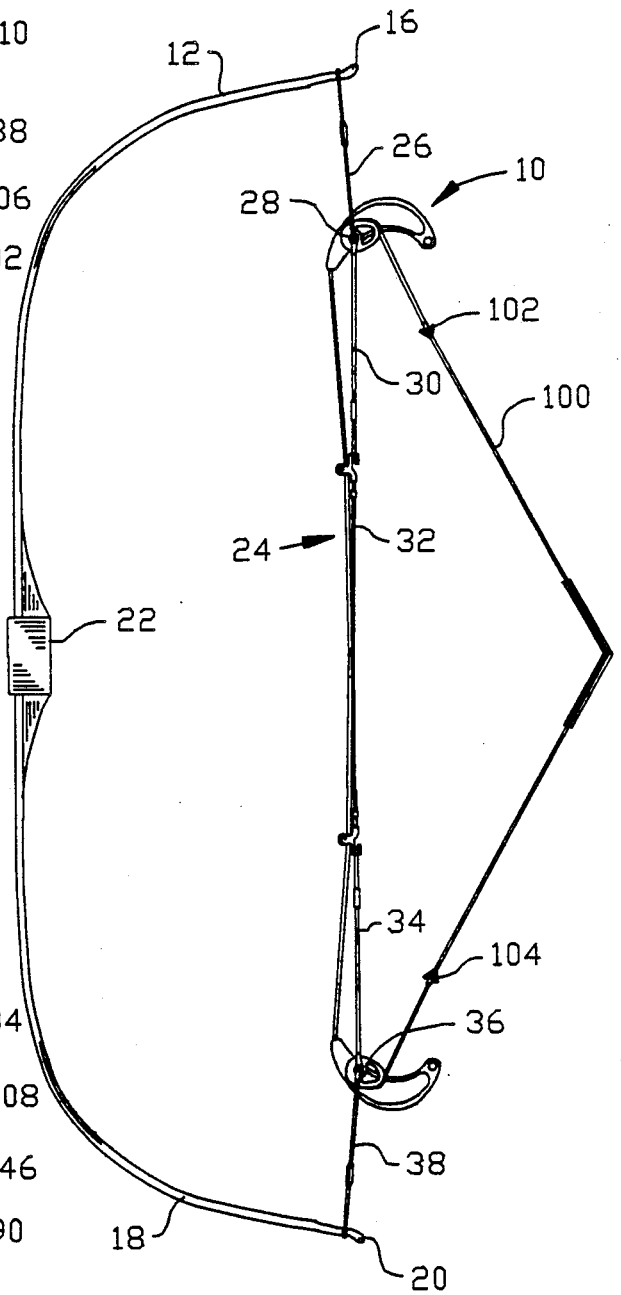
FIG. 2 is a side elevation of the bow apparatus of the invention in a drawn or loaded position.

FIG. 2 is a side elevation of the bow apparatus in a drawn or loaded position.

Figure 3:
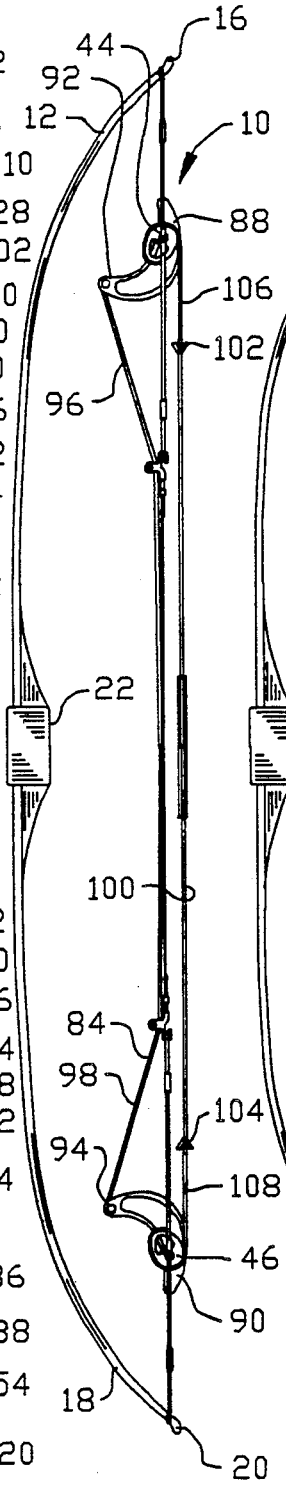
FIG. 3 is a side elevation of the bow apparatus of FIG. 2 in a relaxed position.

FIG. 3 is a side elevation of FIG. 2 in a relaxed position.

Figure 4:
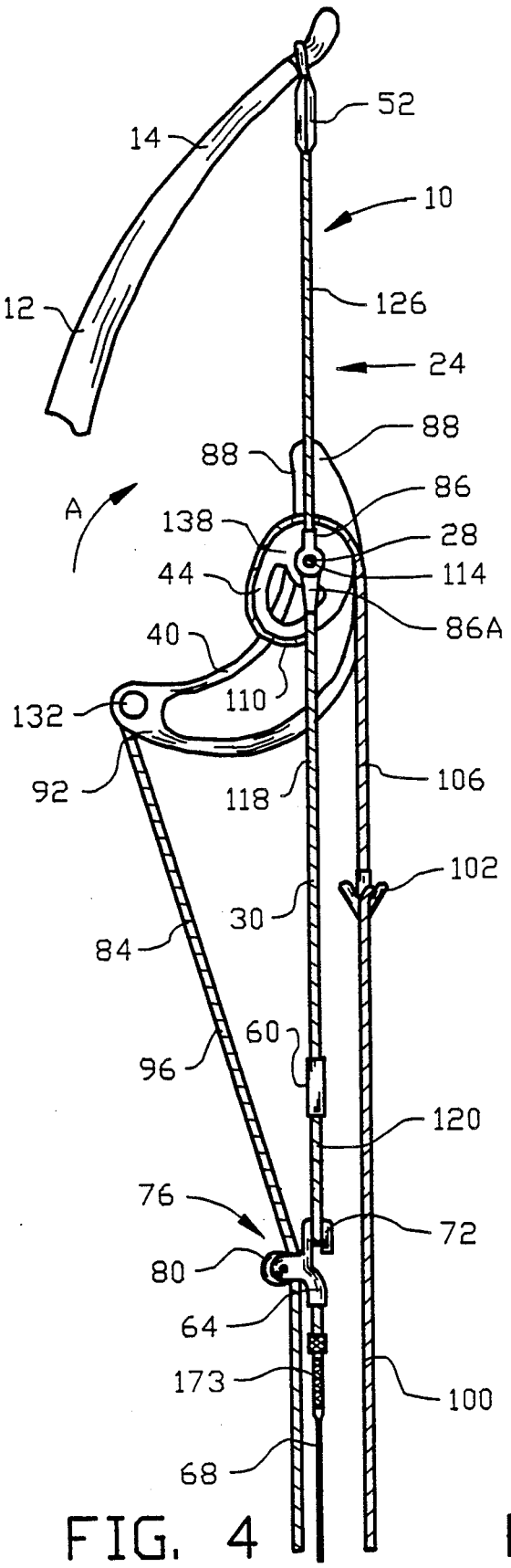
FIG. 4 is a bowstring apparatus in an enlarged side elevation of the upper limb tip of FIG. 3.

FIG. 4 of the bowstring apparatus 10 illustrates an enlarged elevation view of the upper limb tip of FIG. 3. THe same construction is duplicated at the lower limb of the bow. That is, the corresponding view of the apparatus at the opposite limb would be essentially identical and is not illustrated. The upper bow limb tip 16 is securely attached by loop 48 of first flexible cord connector 26 of tip interconnecting means 24. Loop anchor 52 securely positions loop 48 to further provide for secure attachment to upper bow limb tip 16. The loop anchor 52 allows bowstring apparatus 10 to be removably connected to upper 16 and lower (not shown) limb tip 20 to enable detachment of apparatus 10 from the bow. The first end of first flexible cord connector 126 includes eyelets 86 and 86B (not shown) to securably attach to proximal end 114 and distal end 116 (not shown) to first axle pin 28. The inside diameter of eyelet 86,86B is slightly larger than the outside of the axle pin 28 to enable a friction fit. Other methods of securing the axle pins to the tip interconnecting means are well within one skilled in the art. The first end 118 of third flexible connector cord 30 attaches to proximal end 114 and distal end 116 (FIG. 5) of first axle pin 28 by the use of eyelets 86A and 86D. The second end 120 of third flexible cord connector 30 uses a loop anchor 60 in order to position loop 56 (FIG. 5) which connects up with first attachment means 64 at first end of the interlinking flexible cord connector 68. The first attachment 64 means is integrally formed providing a hook 72 and first flexible cable guide 76 which utilizes wheel 80 to guide flexible cord member 84 as distal end 92 of arc member 40 rotates in a direction indicated by arrow "A" (clockwise) when the bowstring 100 is tensioned. A first bowstring cable 106 is attached to first ring member 44 at string anchor 124 (not shown) and warps the periphery 110 of first ring member 44 and terminates at first anchor harness 102. A bowstring 100 is disposed between a first anchor harness 102 and second anchor harness 104 as illustrated at FIG. 2.

Figure 5:
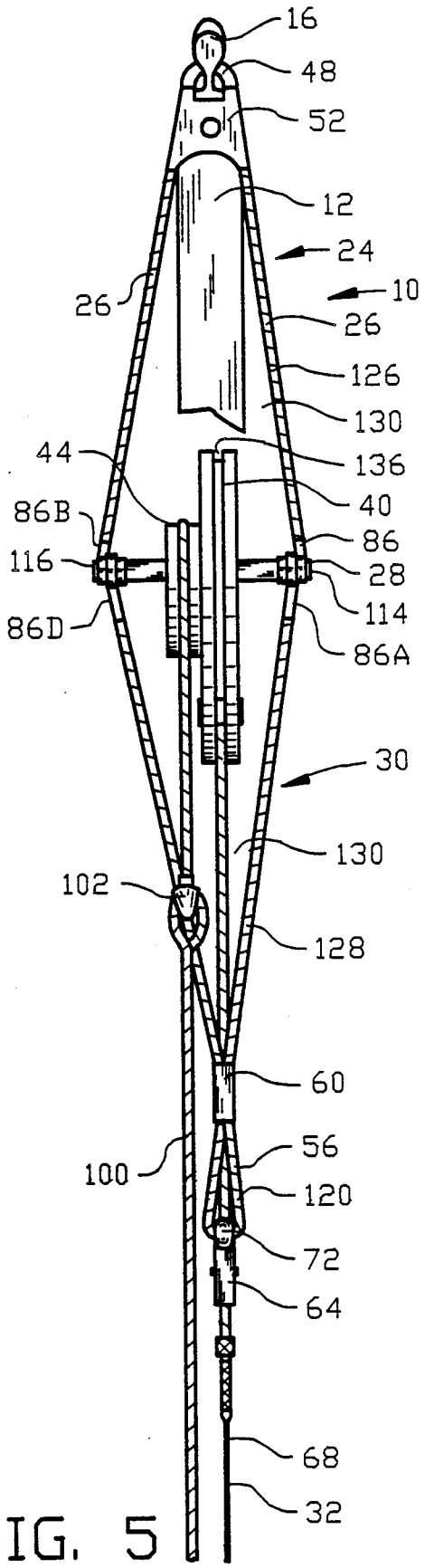
FIG. 5 illustrates a bottom view of the bowstring apparatus as shown at FIG. 4.

FIG. 5 illustrates a bottom view of the bowstring apparatus as illustrated in FIG. 4. FIG. 5 illustrates an area defined by first end of 126 of first flexible cord connector 26 and first end 128 of third flexible cord connector 30, defining a cord window 130. The cord window 130 enables rotation therethrough of arc member 40,42 and ring member 44,46 when bowstring 100 is tensioned. First axle pin 28 provides an attachment surface for eyelets 86,86B of first flexible cord connector 26 and for eyelets 86A,86D of third flexible cord connector 30 with arc member 40 and ring member 44 axially spaced on axle pin 28 to provide cord window 130.

Figure 6:
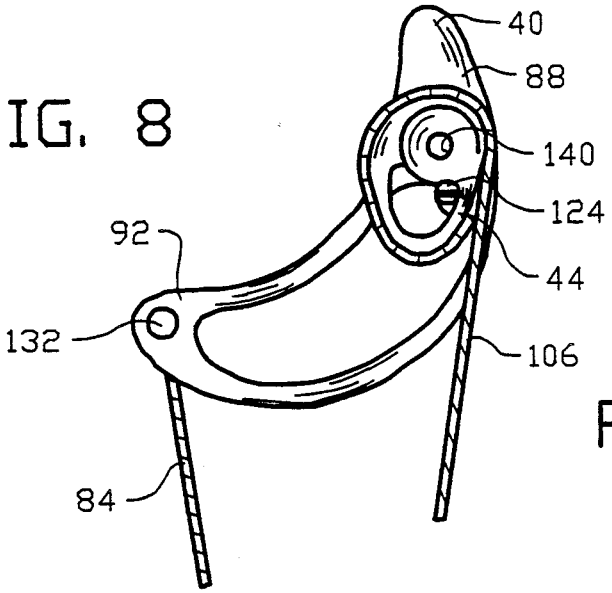
FIG. 6 illustrates the arc member and ring member of FIG. 4 absent the tip interconnecting means and the axle pin.

FIG. 6 illustrates a side view of arc member and ring member of FIG. 4 in strung or relaxed position absent tip interconnecting means 24 and axle pins 28,36. The string anchor 124 securely attaches the first bowstring cable 106 to ring member 44 to enable bowstring cable 106 to be placed about the periphery 110 of ring member 44. The arc member 40 is attached to ring member 44 at its proximal end 88 with its distal end 92 providing a flexible cord member attachment anchor 132 to securably attach flexible cord member 84 to distal end 92 of arc member 40.

Figure 7:
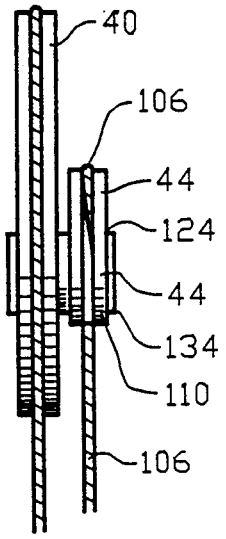
FIG. 7 illustrates a bottom view of FIG. 6.

FIG. 7 illustrates a bottom view of FIG. 6. This view illustrates the integral attachment of arc member 40 and ring member 44. The string anchor 124 securably attaches first bowstring 106 within a guiding channel 134 at its periphery 110 to enable the first bowstring to be guidably released from ring member 44. The arc member 40 is shown with flexible cord member 84 within a guiding channel 136.

Figure 8:
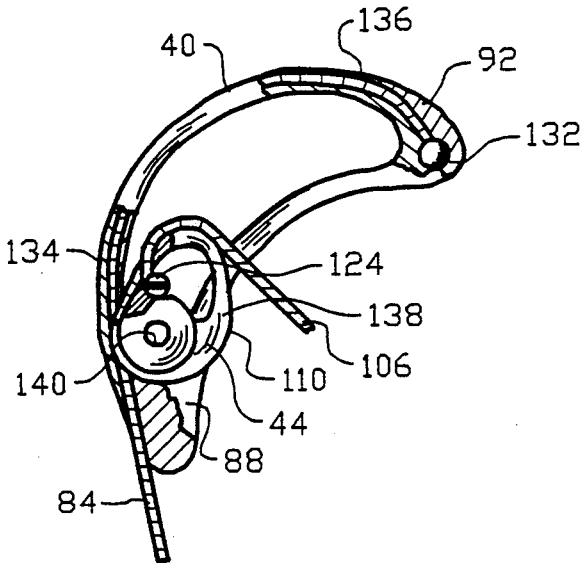
FIG. 8 illustrates a partial sectional view of FIG. 6 in a drawn or loaded position showing the guiding channels of the ring member and arc member absent the tip interconnecting means and the axle pin.

FIG. 8 illustrates a partial sectional view of FIG. 6 in a drawn or loaded position showing guiding channel 134, 136 of ring member 44 and arc member 40, respectively, but absent the tip interconnecting means 24 and axle pin 28. The guiding channel 136 as shown at distal portion 92 of arc member 40 and proximal portion of the arc member 88 illustrates the preferred embodiment for guiding flexible cord member 84. The flexible cord member 84 is securely attached to distal end 92 of arc member 40 by flexible cord member anchor 132. Ring member 44 is an eccentric wheel 138 having an axle bore 140 extending through ring member 44 and through arc member 40. The partial sectional view of ring member 44 illustrates string anchor 124 securing first bowstring cable 106 to ring member 44 as first bowstring cable 106 proceeds about periphery 110 of ring member 44 to anchor harness (not shown).

FIGS. 9–13 illustrate different arc member designs and points of attachment of the flexible cord member to the distal end portion of the arc member. The ring members of FIGS. 9–12 are all eccentric. The ring member of FIGS. 13A and 13B are concentric. The ring members are arc members of 9–13 are securably attached to each other in order to maintain a simultaneously rotation about the axle pin. The teachings disclosed herein also apply to modifications set forth in FIGS. 9–13.

Figure 9A:
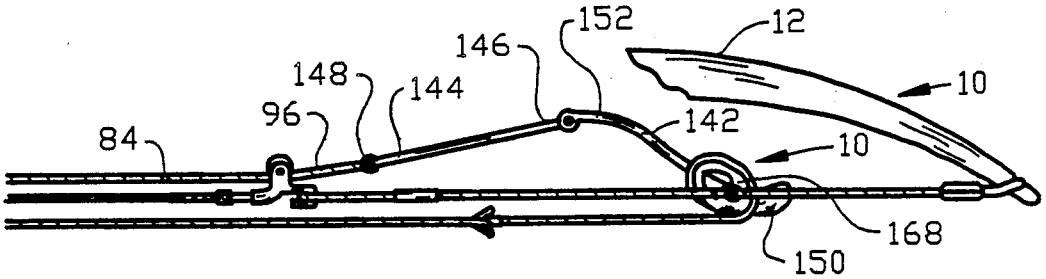
FIG. 9A and 9B illustrate an elevational and a plan view, respectively, of an embodiment of the invention which illustrates the upper limb portion of the bowstring apparatus illustrated at FIG. 1.
Figure 9B:
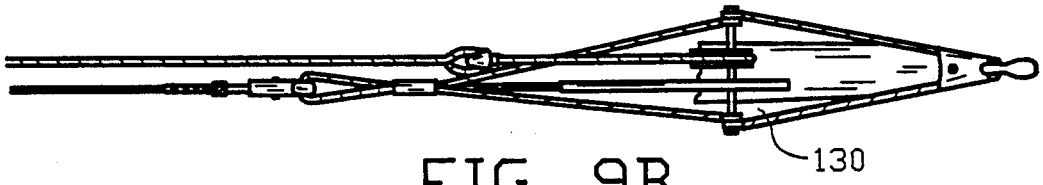
Figure 13A:
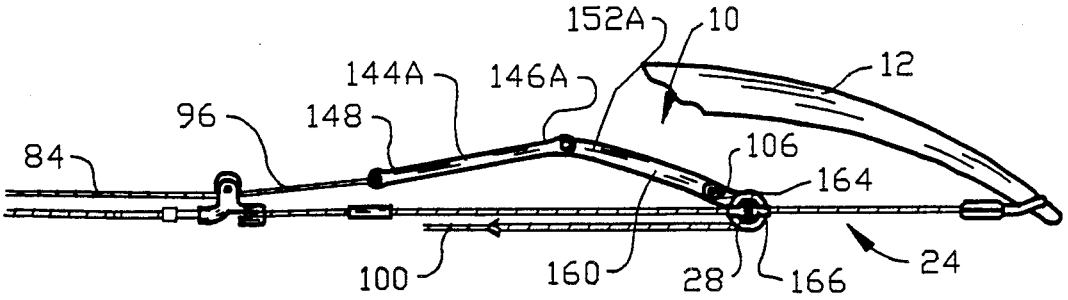
FIGS. 13A and 13B illustrate an elevational view and a plan view, respectively, of another embodiment of the invention which illustrates the upper limb portion of the bowstring apparatus.
Figure 13B:
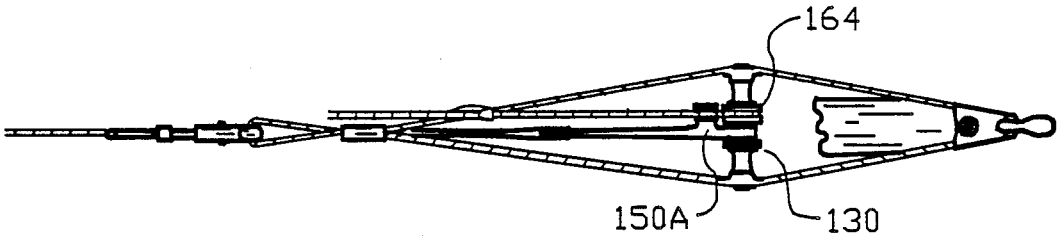

FIGS. 9A and 9B illustrate a further embodiment of the invention where the arc member 142, having a proximal end 150 and distal end 152 further includes bridge member 144 having a first 146 and second 148 end. First end 146 of bridge member 144 movably attaches to distal end 152 of arc member 142 and second end 148 of bridge member 144 attaches to first end 96 of flexible cord member 84. FIGS. 13A and 13B illustrate a similar arrangement of the arc member. Preferably, bridge member 144 is constructed of a rigid material such as metal.

Figure 10A:
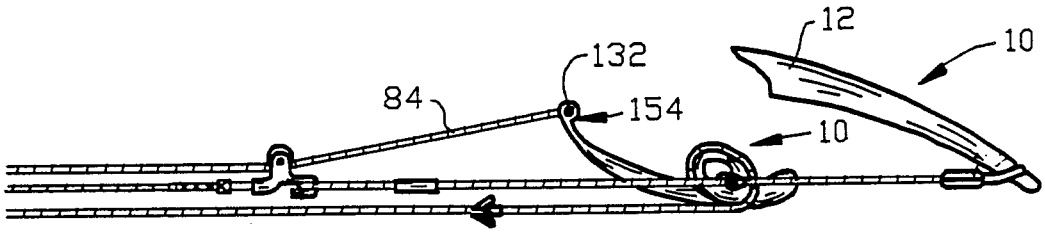
FIGS. 10A and 10B illustrate an elevational view and a plan view, respectively, of another embodiment of the invention which illustrates the upper limb portion of the bowstring apparatus.
Figure 10B:
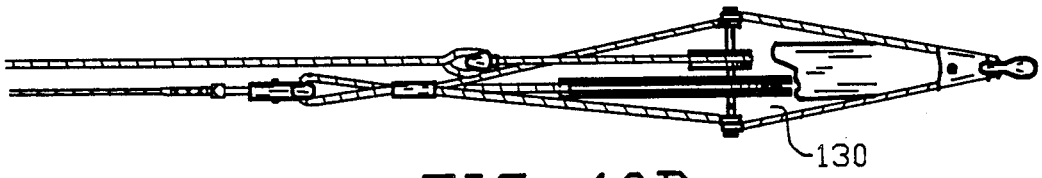
Figure 11A:
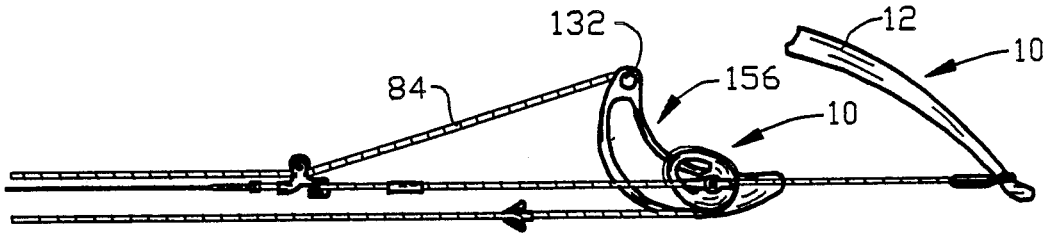
FIGS. 11A and 11B illustrate an elevational view and a plan view, respectively, of another embodiment of the invention which illustrates the upper limb portion of the bowstring apparatus.
Figure 11B:
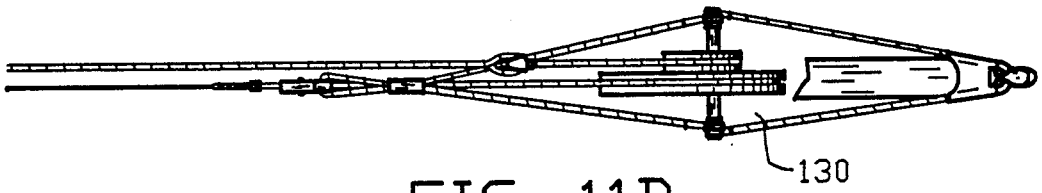
Figure 12A:
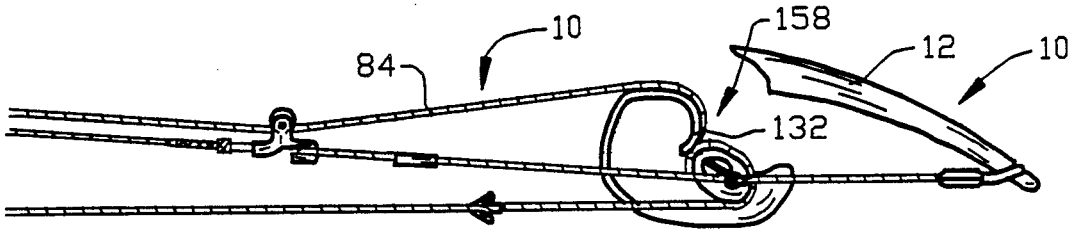
FIGS. 12A and 12B illustrate an elevational view and a plan view, respectively, of another embodiment of the invention which illustrates the upper limb portion of the bowstring apparatus.
Figure 12B:
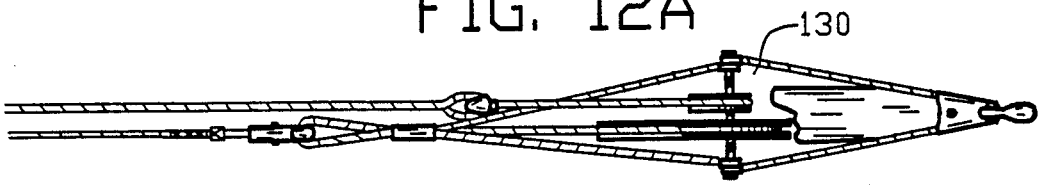

FIGS. 10A,B to 12A,B illustrate arc members 154, 156 and 158 directly attaching to the flexible cord member 84 by means of a flexible cord member anchor 132. FIGS. 1, 9 and 10 illustrate the apparatus of the invention where the flexible cord member is not guidably received about the periphery of the arc member.

FIGS. 13A and 13B illustrate a modification of the embodiment of the invention shown at FIGS. 9A and 9B. Arc member 160, having a proximal end 150A and distal end 152A further includes bridge member 144A having a first end 146A and second end 148A. A ring member 164 is concentric and the bowstring cable 106 attached to the arc member 160 after first traveling about a portion of the periphery of the ring member 164. The joined or integrally formed eyelets 166 illustrate another method of attaching the axle pin 28 to the tip interconnecting means 24. Preferably, bridge member 144A is constructed of a rigid material such as metal.

Figure 14:
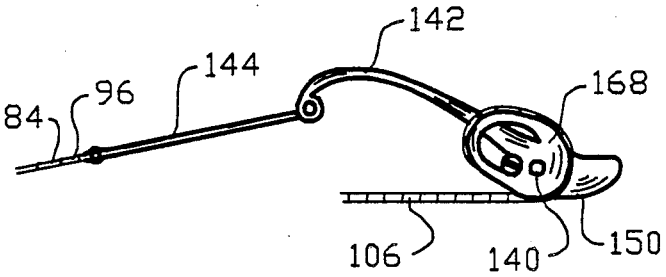
FIG. 14 illustrates the ring member and arc member of the bow apparatus as set forth in FIGS. 9A and 9B further illustrating the bow in a not loaded position.

FIG. 14 illustrates the ring member 168 and arc member 142 of the bow apparatus 10 as set forth in FIGS. 9A and 9B further illustrating the bow in a strung (relaxed) position absent the tip interconnecting means 24 and axle pin 28. Axle bore 140 enables the axle pin to be received therethrough.

Figure 15:
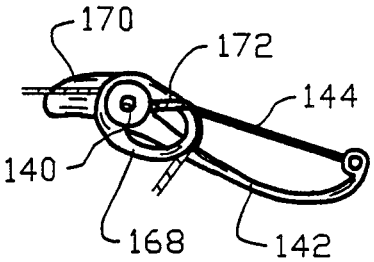
FIG. 15 illustrates a partial sectional view of the bowstring apparatus set forth in FIG. 14 showing the guiding channels of the arc member and ring member.

FIG. 15 illustrates a partial sectional view of the bowstring apparatus as set forth in FIG. 14 illustrating the bow apparatus in a drawn or loaded position absent the tip interconnecting means and axle pin and further showing the guiding channels 170,172 of the arc member 142 and ring member 168 respectively. The guiding channel 172 of the arc member 142 appears at the proximal end 150 of the arc member 142. The guiding channel of the ring member is substantially about the circumference of the ring member 168.

Figure 16:
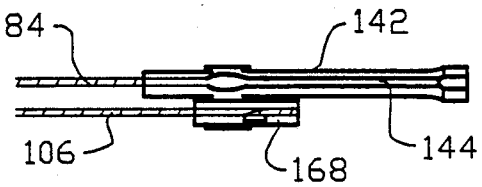
FIG. 16 illustrates the bottom view of the bowstring apparatus set forth in FIG. 15.
Figure 17A:
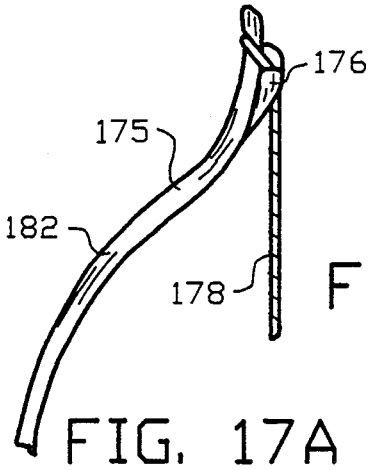
FIG. 17A, 17B, 17C and 17D illustrate a string raiser for use with a recurve bow.
Figure 17B:
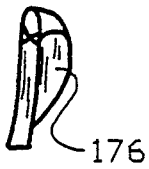
Figure 17C:
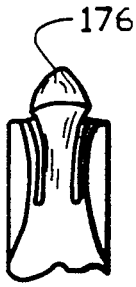
Figure 17D:
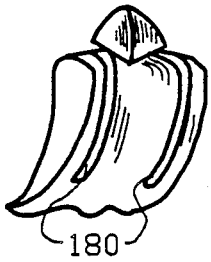

FIG. 16 illustrates a bottom view of the bowstring apparatus as set forth in FIG. 15.

FIG. 17 illustrates the placement of string riser 176 on upper limb tip of recurve bow 175. This enables the bowstring device 10, particularly the arc member, such as 40, to rotate without being obstructed by the structure of the recurve bow 182. First flexible cord connector 178 is guidably held in position on the recurve bow 182 by grooves 180.

Figure 18:
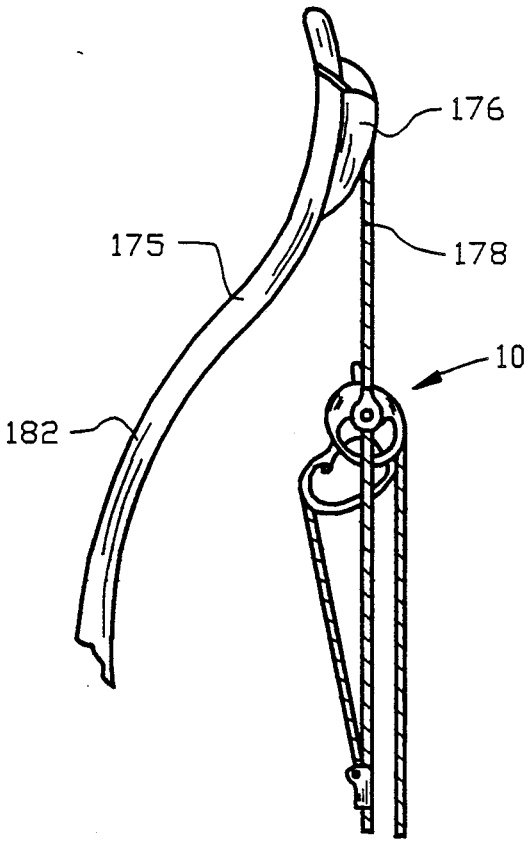
FIG. 18 illustrates a side view of another embodiment of the invention for use with a recurve bow.

FIG. 18 illustrates a side view of string raiser 176 on recurved blow 182 with the bowstring apparatus 10.

Figure 19:
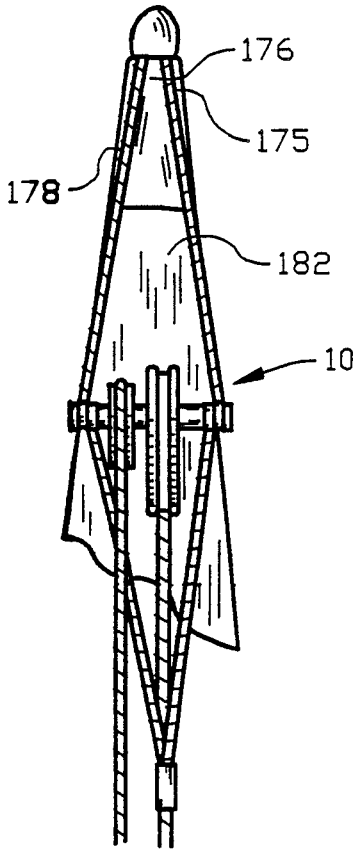
FIG. 19 illustrates a bottom view of the bowstring apparatus as shown at FIG. 18.

FIG. 19 illustrates a bottom view of FIG. 18. Generally on a recurve bow a loop anchor such as 52 is not needed and is replaced by string raiser 176. A string raiser is needed at both the upper and lower bow limb tips.

Generally, as the circumference of the arc member and therefore the length of the guiding channel thereon, is increased, the draw force needed to drawn the bow to a loaded position increases. To offset this, the circumference of the ring member and therefore the length of the gliding channel thereon, is decreased. The arc member should be smoothly shaped to promote a gradual rather than an abrupt breakover to insure smooth delivery of the arrow being propelled by the bow by way of the bowstring when the bowstring is released by the archer. Breakover occurs when the bow is being drawn to the loaded position and the force required to draw the bow drops.

Generally, the length of flexible cord 84 taken up by the arc member is the length the bow limbs flex. That is, four inches of cord 84 are taken up by arc member 154, the bow limbs flex in about four inches.

The angular displacement of the ring members-arc members at opposite limb tips are substantially equal in magnitude with respect to one another but opposite in direction. The relative size of both ring members is the same, as is the relative size of the arc members.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A bowstring apparatus for use with an archer's bow including a handle, upper and lower flexible limbs extending from the handle and each limb terminating in an upper and lower limb tip, respectively, comprising:

a first and second axle pin;

a first ring member rotatably mounted on said first axle pin and a second ring member mounted on said second axle pin, to enable rotation relative each said axle pin and wherein each said first and second ring members are eccentric ring members relative to said first and second axle pins, respectively;

as first arc member rotatably mounted on said first axle pin and a second arc member rotatably mounted on said second axle pin, axially spaced and extending away from said respective ring member and each said arc member having a proximal and distal end, said first and second arc members each comprising:

a first curved member having a first tapered radius of curvature;

a second curved member having a second tapered radius of curvature larger, at least along a portion of said member, than said first radius of curvature, said tapering curvatures causing said first and second curved members to intersect at two points to form said proximal and distal ends of said arc members;

each of said proximal end of said first and second arc member being securely attached to each of said first and second ring members respectively to enable in use simultaneous rotation about said first and second axle pins upon rotation of said ring member;

a tip interconnector means attachably securing in use each upper and lower limb tip to each said first and second axle pins respectively;

said tip interconnector means further interconnects said first axle pin and said second axle pin to interlink in use the upper blow limb and the lower bow limb and to suspend from the upper limb tip and from the lower limb tip in use said first ring member and said first arc member rotatably mounted on said first axle pin and said second ring member and said second arc member rotatably mounted on said second axle pin thereby positioning between the upper bow limb tip and the lower bow limb tip said first ring and first arc members and said second ring and second arc members to enable rotation of said first ring member and said second ring members about said first axle pin and said second axle pin respectively without interference from the upper and lower bow limbs of the archer's bow;

flexible cord means extending between and attachably securing together each said distal end of said arc member to enable simultaneous tensioning with said ring member when said ring member is tensioned;

a bowstring secured to each of said first and second rotatably mounted ring members and extending between each of said first and second rotatably mounted ring members; and each said second curved member of said first and second arc members further including a guiding channel on their outer periphery whereby drawing said bowstring tensions the upper and lower limbs and enables said first and second ring members to rotate thereby permitting said bowstring to be rotatably released from said first and second rotatably mounted rings and further enables a flexible cable member to be guidably and rotatably received by each said guiding channel of each said first and second arc members thereby mechanically storing the force to tension said bowstring and enabling said bowstring to be held in a firing position and upon release of said bowstring said flexible cord means guidably and rotatably received on said arc members and said first and second rotatably mounted rings cooperate to apply substantially all of said stored force to said bowstring.

2. The bowstring apparatus of claim 1 wherein said tip interconnecting means is removably connected to each upper and lower limb tip to enable detachment of the bowstring apparatus from the archer's bow.

3. The bowstring apparatus of claim 1 wherein said first and second ring members further include a guiding channel for said bowstring to enable in use said bowstring to be guidably released by said ring member said bowstring is in a drawn position.

4. The bowstring apparatus of claim 3 wherein said tip interconnector means further comprises:

a first flexible cord connector having a first end and a second end;

said first end of said first flexible cord connector comprises a plurality of cords;

said plurality of cords terminate in an attachment means for securably connecting said first flexible cord connector to said proximal end and said distal end of said first axle pin;

said second end of said first flexible cord connector comprises a loop for securably connecting in use said first flexible cord to the upper limb tip of the archer's bow;

a second flexible cord connector having a first end and a second end;

said first end of said second flexible cord connector comprises a plurality of cords;

said plurality of cords terminate in an attachment means for securably connecting said second flexible cord connector to said proximal end and said distal end of said second axle pin;

said second end of said second flexible cord connector comprises a loop for securably connecting in use said second flexible cord to the lower limb tip;

a third flexible cord connector having a first end and a second end;

said first end of said third flexible cord connector comprises a plurality of cords;

said plurality of cords terminate in an attachment means for securably connecting said first end of said third flexible cord connector to said proximal and distal ends of said first axle pin;

said second end of said third flexible cord connector comprises a loop;

a fourth flexible cord connector having a first end and a second end;

said first end of said fourth flexible cord connector comprises a plurality of cords;

said plurality of cords terminate in an attachment means for securably connecting said first end of said fourth flexible cord connector to said proximal and distal ends of said second axle pins;

said second end of said fourth flexible cord connector comprises a loop;

an interlinking flexible cord connector having a first and a second end; and said first and second ends of said interlinking flexible cord connector further including a first and second attachment means for securably attaching said loop of said third flexible cord connector to said first attachment means of said interlinking cord and for securably attaching said loop of said fourth flexible cord connector to said second attachment means of said interlinking flexible cord thereby securably interconnecting in use the upper limp tip and the lower limb tip with the bowstring apparatus disposed therebetween.

5. The bowstring apparatus of claim 4 wherein the number of said plurality of cords terminating in an attachment means securably attaching said proximal and distal ends of said first and second axle pins is two thereby enabling said first and second ring members and is a first and second arc members rotatably mounted on said first and second axle pins, respectively, to be disposed between and rotate within the area defined by said first end of said first flexible connector cord and said first end of said third flexible connector cord and the area defined by said first end of second flexible connector cord and said first end of said fourth flexible connector cord, respectively.

6. The bowstring apparatus of claim 4 wherein said first and second attachment means comprise:

a hook for attaching said interlinking flexible cord connector to each said loop of said third and fourth flexible cord connectors.

7. The bowstring apparatus of claim 6 wherein said first and second attachment means further include flexible cord guide for guiding said flexible cord during the drawing of said bowstring.

8. The bowstring apparatus of claim 7 wherein said hook of said first and second attachment means and said flexible cord guide of said first and second attachment means are integrally formed.

9. The bowstring apparatus of claim 4 wherein said interlinking flexible cord further comprises:

an adjustment means for adjusting the tension of the tip interconnecting means.

10. The bowstring apparatus of claim 9 wherein said adjustment means is a turnbuckle.

11. The bowstring apparatus of claim 4 wherein said first and second flexible cord connectors further include a loop anchor to fixedly position said loop between said first and second ends of each of said first and second flexible cord connectors respectively to ensure a more secure attachment of said first and second flexible cords to the upper and lower limb tips respectively.

12. The bowstring apparatus of claim 4 wherein said third and fourth flexible cord connectors further include a loop anchor to fixedly position said loop to said first and second attachment means of said first and second interlinking flexible cord connectors respectively to ensure a more secure attachment of said third and fourth flexible cords to said interlinking flexible cord connector.

13. The bowstring apparatus of claim 1 wherein each of said axle pin further comprises a proximal end and a distal end.

14. The bowstring apparatus of claim 1 wherein said first and second rotatably mounted ring members further include an axle bore to slidably receive said axle pin to enable rotation about said axle pin.

15. The bowstring apparatus 14 wherein said axle bore is positioned in each said ring member at a point equal in distance from the circumference of said ring member.

16. The bowstring apparatus of claim 1 wherein said first and second rotatably mounted ring members further include an axle bore to slidably receive first and second said axle pins respectively to enable rotation about each said first and second axle pins of each said first and second rotatably mounted ring members.

17. The bowstring apparatus of claim 16 wherein said axle bore is positioned in each said first and second ring members at a point not equal in distance from the circumference of said first and second ring members.

18. The bowstring apparatus of claim 1 wherein said first ring member and said first arc member are integrally formed, 19. The bowstring apparatus of claim 1 wherein said second ring member and said second arc member are integrally formed.

20. The bowstring apparatus of claim 1 wherein each said first and second rotatably mounted arc members further include an axle bore to slidably receive said axle pin to enable rotation about said axle pin.

21. The bowstring apparatus of claim 1 for use on a recurve bow wherein said tip interconnector means further includes a string raiser positioned at the upper and lower bow limb tips to move said tip interconnector means vertically relative the upper and lower limb tips to enable said arc member to rotate relative said axle pin without being obstructed by the upper and lower bow limbs when said bowstring is drawn.

22. The bowstring apparatus for use with an archer's bow including a handle, upper and lower limbs extending from the handle and each limb terminating in an upper and lower limb tip, respectively, comprising:

a first and second axle pin;

a first ring member rotatably mounted on said first axle pin, and a second ring member rotatably mounted on said second axle pin, respectively, to enable rotation relative to said axle pins and wherein each said first and second ring member are eccentric ring members relative to said first and second axle pins, respectively;

a first arc member rotatably mounted on said first axle pin and a second arc member rotatably mounted on said second axle pin, each said arc member axially spaced and extending away from said respective first and second ring members and having a proximal and distal end, said first and second arc members each comprising:

a first curved member having a first tapered radius of curvature;

a second curved member having a first tapered radius of curvature larger, at least along a portion of said member, than said first radius of curvature, said tapering curvatures causing said first and second curved members to intersect at two points to form said proximal and distal ends of said arc members;

each said proximal end of said first and second arc members being securely attached to each of said first and second ring members to enable in use simultaneous rotation about said first and second axle pins upon rotation of said ring members;

a tip interconnector means attachably securing in use each upper and lower limb tip to each said first and second axle pins respectively;

said tip interconnector means further interconnects said first axle pin and said second axle pin to interlink in use the upper bow limb and the lower bow limb and to suspended from the upper limp tip and from the lower limb tip in use said first ring member and said first arc member rotatably mounted on said first axle pin and said second ring member and said second arc member rotatably mounted on said second axle pin thereby positioning between the upper bow limb tip and the lower bow limb tip said first ring and first arc members and said second ring and second arc members to enable rotation of said first ring member and said second ring members about said first axle pin and said second axle pin respectively without interference from the upper and lower bow limbs of the archer's bow;

flexible cord means extending between and attachably securing together each said distal end of said arc member to enable simultaneous tensioning with said ring member when said ring member is tensioned; and a bowstring secured to each of said first and second rotatably mounted ring members and extending between each of said first and second rotatably mounted ring members whereby drawing in use said bowstring tensions the upper and lower limbs and enables said first and second ring members to rotate thereby permitting said bowstring to tension each said distal end of said first and second arc members and enabling each said first and second ring member to guidably and rotatably release said bowstring thereby mechanically storing the force to tension said bowstring and enabling said bowstring to be held in a firing position and upon release of said bowstring said flexible cord means guidably tensioned by said distal ends of each said first and second arc member cooperate to apply substantially all of said stored force to said bowstring.

23. The bowstring apparatus of claim 22 wherein said tip interconnecting means is removably connected in use to each upper and lower limb tip to enable detachment of the bowstring apparatus of the archer's bow.

24. The bowstring apparatus of claim 22 wherein said first and second ring members further include a guiding channel for said bowstring to enable said bowstring to be guidably released by said ring member when said bowstring is in a drawn position.

25. The bowstring apparatus of claim 22 wherein each of said axle pin further comprises a proximal end and a distal end.

26. The bowstring apparatus of claim 25 wherein the tip interconnector means further comprises:

a first flexible cord connector having a first end and a second end;

said first end of said first flexible cord connector comprises a plurality of cords;

said plurality of cords terminate in an attachment means for securably connecting said first flexible cord connector to said proximal end and said distal end of said first axle pin;

said second end of said first flexible cord connector comprises a loop for securably connecting in use said first flexible cord to the upper limb tip;

a second flexible cord connector having a first end and second end;

said first end of said second flexible cord connector comprises a plurality of cords;

said plurality of cords terminate in an attachment means for securably connecting said second flexible cord connector to said proximal end and distal ends of said second axle pin;

said second end of said second flexible cord connector comprises a loop for securably connecting said second flexible cord to the lower limb tip;

a third flexible cord connector having a first end and a second end;

said first end of said third flexible cord connector comprises a plurality of cords;

said plurality of cords terminate in an attachment means for securably connecting said first end of said third flexible cord connector to said proximal end and said distal end of said first axle pin;

said second end of said third flexible cord connector comprises a loop;

a fourth flexible cord connector having a first end and a second end;

said first end of said fourth flexible cord connector comprises a plurality of cords;

said plurality of cords terminate in an attachment means for securably connecting said first end of said fourth flexible cord connector to said proximal end and said distal end of said second axle pin;

said second end of said fourth flexible cord connector comprises a loop;

an interlinking flexible cord connector having a first end and second end; and said first end and second ends of said interlinking flexible cord connector further including a first and second attachment means for securably attaching said loop of said third flexible cord connector to said first attachment means of said interlinking cord and for securably attaching said loop of said fourth flexible cord connector to said second attachment means of said interlinking flexible cord thereby securably interconnecting in use the upper limb tip and the lower limb tip with the bowstring apparatus disposed therebetween.

27. The bowstring apparatus of claim 26 wherein the interlinking flexible cord further comprises:

an adjustment means for adjusting the tension of the tip interconnecting means.

28. The bowstring apparatus of claim 27 wherein the adjustment means is a turnbuckle.

29. The bowstring apparatus of claim 26 wherein said first and second flexible cord connectors further includes a loop anchor to fixedly position said loop along between said first and said second ends of each of said first and second flexible cord connectors respectively to ensure a more secure attachment of said first and second flexible cords to the upper and lower limb tips respectively.

30. The bowstring apparatus of claim 26 wherein said third and fourth flexible cord connectors further includes a loop anchor to fixedly position a loop between said first and second ends of each of said third and fourth flexible cord connectors respectively to insure a more secure attachment of said third and fourth flexible cords to said first and second attachment means of said interlinking flexible cord connector.

31. The bowstring apparatus of claim 26 wherein the number of said plurality of cords terminating in an attachment means securably attaching said proximal and distal ends of said first and second axle pins is two thereby enabling said first and second ring members and said first and second arc members rotatably mounted on said first and second axle pins, respectively, to be disposed between and rotate within the area defined by said first end of said first flexible connector cord and said first end of said third flexible connector cord and the area defined by said first end of second flexible connector cord and said first end of said fourth flexible connector cord, respectively.

32. The bowstring apparatus of claim 26 wherein said first and second attachment means comprise:

a hook for attaching said interlinking flexible cord connector to each said loop of said third and fourth flexible cord connectors.

33. The bowstring apparatus of claim 32 wherein said first and second attachment means further include flexible cord guide for guiding said flexible cord during the drawing of said bowstring.

34. The bowstring apparatus of claim 33 wherein said hook of said first and second attachment means and said flexible cord guide of said first and second attachment means are integrally formed.

35. The bowstring apparatus of claim 26 wherein said interlinking flexible cord further comprises:

an adjustment means for adjusting the rigidity of the tip interconnecting means.

36. The bowstring apparatus of claim 26 wherein said flexible cord member further includes a first end and a second end; and each said distal end of each said arc member further includes a rotatably attached rigid bridge member having a first end and a second end for attachably securing each said distal end of each said first and second arc members to each said first end of said rigid bridge member and each said second end of each said rigid bridge member securably attaching each said first and second ends of said flexible cord, respectively.

37. The bowstring apparatus of claim 26 wherein said first and second rotatably mounted arc members further include an axle bore to slidably receive said axle pin to enable rotation about said first and second axle pin respectively.

38. The bowstring apparatus of claim 22 wherein each said first and second mounted ring members further includes an axle bore to slidably receive said first and second axle pins respectively to enable rotation about each said axle pin of said first and second rotatably mounted ring members respectively.

39. The bowstring apparatus of claim 38 wherein said axle bore is positioned at a point equal in distance from the circumference of said rings.

40. The bowstring apparatus of claim 38 wherein each said axle bore of said first and second rotatably mounted ring members is positioned at a point not equal in distance from the circumference of said first and second rotatably mounted ring members.

41. The bowstring apparatus of claim 22 wherein said first and second arc members further include an axle bore to slidably receive said axle pin to enable rotation about said axle pin of said first and second arc members.

42. The bowstring apparatus of claim 22 wherein said first ring member and said first arc member are integrally formed.

43. The bowstring apparatus of claim 22 wherein said second ring member and said second arc member are integrally formed.

44. The bowstring apparatus of claim 22 for use on a recurve bow wherein said tip interconnector means further includes a string raiser positioned at the upper and lower bow limb tips to move said tip interconnector means vertically relative the upper and lower limb tips to enable said arc member to rotate relative said axle pin without being obstructed by the upper and lower bow limbs when said bowstring is drawn.

* * * * *